US005779593A

United States Patent [19]

Takada

[11] Patent Number: 5,779,593

[45] Date of Patent: Jul. 14, 1998

[54] ON-VEHICLE CONTROL APPARATUS

[75] Inventor: Mitsuru Takada, Aichi-ken, Japan

[73] Assignee: Toyota Jidosha Kabushiki Kaisha, Toyota, Japan

[21] Appl. No.: 807,690

[22] Filed: Feb. 28, 1997

[30] Foreign Application Priority Data

Mar. 6, 1996 [JP] Japan ..... 8-049350

[51] Int. Cl.[6] ..... F02D 9/02

[52] U.S. Cl. ..... 477/107; 123/400

[58] Field of Search ..... 477/107, 906, 477/907; 123/400

[56] References Cited

U.S. PATENT DOCUMENTS

| | | | |
|---|---|---|---|
| 4,873,957 | 10/1989 | Ueyama et al. | 123/400 |
| 4,962,680 | 10/1990 | Kirstein | 477/907 |
| 5,033,328 | 7/1991 | Shimanaka | 477/906 |
| 5,056,022 | 10/1991 | Witowski et al. | 477/906 |
| 5,297,521 | 3/1994 | Sasaki et al. | 123/400 |
| 5,366,424 | 11/1994 | Wataya | 477/907 |
| 5,415,605 | 5/1995 | Yoshimura et al. | 477/907 |
| 5,447,133 | 9/1995 | Kamio et al. | 123/400 |
| 5,681,240 | 10/1997 | Sunada et al. | 477/906 |

FOREIGN PATENT DOCUMENTS 5-71365 3/1993 Japan .

*Primary Examiner*—Dirk Wright
*Attorney, Agent, or Firm*—Oliff & Berridge, PLC

[57] ABSTRACT

An on-vehicle control apparatus having a throttle valve in an intake passage of the engine is disclosed. The system for actuating the throttle valve includes electric and mechanical components. A electrical motor incorporated in the electric component actuates the throttle valve. An electronic control unit (ECU) controls the motor such that the opening of the throttle valve matches a target opening, which corresponds to a manipulation amount of a gas pedal. When there is an abnormality in the motor, if the gas pedal is manipulated by a predetermined amount or more, the mechanical component couples the gas pedal with the throttle valve, thereby actuating the throttle valve. When there is an abnormality in the motor, the ECU cuts fuel supply to some of the injectors. This allows the actual torque of the engine to be slightly lower than a computed engine torque that corresponds to the amount of a gas pedal manipulation.

11 Claims, 6 Drawing Sheets

ON-VEHICLE CONTROL APPARATUS

BACKGROUND OF THE INVENTION

1. Field of the Invention

The present invention relates generally to a control apparatus for vehicles. More particularly, the present invention relates to a control apparatus that has an electronic controlled throttle valve in an intake passage. The apparatus controls the opening of the throttle valve by electrical and mechanical components.

2. Description of the Related Art

Vehicle engines burn air-fuel mixture in a combustion chamber to gain power. The amount of fuel supplied is controlled in accordance with the amount of air drawn into the combustion chamber. Accordingly, the torque of the engine is controlled.

A throttle valve located in an intake passage controls the amount of air drawn into a combustion chamber. One of the systems for actuating the throttle valve is a mechanical system, in which an gas pedal is coupled to the throttle valve by a wire or the like. In this system, there is a one-to-one correspondence between the amount of the manipulation of a gas pedal (pedal angle) PA and the inclination of a throttle valve (throttle opening) TA. In a so-called electronic controlled throttle system, the throttle opening TA is controlled by an electric component such as an electrically powered actuator. This type of throttle apparatus incorporates a computer for controlling the throttle opening TA. The computer computes a target throttle opening in accordance with the manipulation amount of a gas pedal (gas pedal angle) PA. The computer controls the actuator such that the actual throttle opening TA detected by sensors matches the target throttle opening. In this type of throttle apparatus, the correspondence between the throttle opening TA and the gas pedal angle PA is arbitrarily determined.

Electronic controlled throttle apparatuses must allow the driver to control the throttle valve when a malfunction occurs in an electric component such as the actuator. Japanese Unexamined Patent Publication No. 5-71365, which is incorporated herein by reference, discloses such a throttle apparatus.

As shown in FIG. 8, the throttle apparatus includes an interlocking lever 73 fixed to the axle 72 of a throttle valve 71, an intermediate lever 74 and a throttle lever 75. The interlocking lever 73 rotates with the axle 72. A spring 76 is coupled to the lever 73 to urge the lever in a direction to close the throttle valve 71. A weaker spring 76A acts to open the throttle valve 71. Levers 74 and 75 pivot with respect to the axle 72. A cable 77, an end of which is coupled to the throttle lever 75, is connected to a gas pedal (not shown). The throttle lever 75 is normally separated from the intermediate lever 74. Pressing the gas pedal against the force of spring 76B over a predetermined amount causes the throttle lever 75 to contact the intermediate lever 74. The resulting pivoting motion of the intermediate lever 74 permits the lever 73 to open the throttle valve 71 under the force of spring 76A. The driver's manipulation of the gas pedal is thus mechanically transmitted to the throttle valve 71.

An electromagnetic clutch 78 is attached to the axle 72. An electrical motor 79 is located next to the clutch78. When actuated, the clutch 78 couples the motor 79 with the throttle valve 71. De-actuating the clutch 78 disconnects the motor 79 from the throttle valve 71.

When a malfunction occurs in the motor 79, the electromagnetic clutch 78 is de-actuated to disconnect the motor 79 from the throttle valve 71. In this case, the throttle lever 75 does not contact the intermediate lever 74 until the gas pedal is manipulated over a predetermined amount. Before the throttle lever 75 contacts the intermediate lever 74, the manipulation of the gas pedal does not affect the movement of the throttle valve 71. The throttle valve 71, which is urged by the spring 76, is fully closed regardless of the gas pedal manipulation. When the gas pedal is manipulated over the predetermined amount, on the other hand, the throttle lever 75 contacts the intermediate lever 74. This mechanically connects the gas pedal and the throttle valve 71. The manipulation of the gas pedal is thus reflected on the movement of the throttle valve 71.

The graph of FIG. 9 shows the relationship between the throttle opening TA and the gas pedal angle PA when the motor 79 does not function normally. In this graph, a gas pedal angle PA, at which the throttle lever 75 contacts the intermediate lever 74, is used as a predetermined angle $\alpha$. When a gas pedal angle PA is smaller than the angle $\alpha$, the throttle opening TA is zero. When the gas pedal angle PA is over the angle $\alpha$, the throttle opening TA increases in proportion with the gas pedal angle PA.

In other words, manipulation of the gas pedal does not increase the power of the engine before it reaches the angle $\alpha$. This may encourage the driver to abruptly step on the gas pedal to increase the engine power. An abrupt manipulation of the gas pedal causes the throttle lever 75 to contact the intermediate lever 74 and suddenly increases the throttle opening TA. As shown in FIG. 10, the engine torque abruptly increases, accordingly. This affects the drivability of the vehicle.

The throttle apparatus of the above publication is intended for a vehicle having an automatic transmission. In this case, the gears are shifted at a higher vehicle speed SPD when a malfunction occurs. This also affects the drivability of the vehicle.

The graph of FIG. 11 shows the relationship between the gas pedal angle PA and the throttle opening TA in a vehicle having an automatic transmission. The two-dot chain line indicates normal functioning while the solid line shows the relationship when the electric component is malfunctioning. In the normal state, a throttle opening TA1 is obtained when the pedal angle PA is PA1 ($<\alpha$). Contrarily, when there is a malfunction, TA1 is obtained only when the pedal angle PA reaches PA2 ($>\alpha$).

The graph of FIG. 12 shows function data applied to control of an automatic transmission. Solid and one-dot chain lines show shift reference lines. These lines are referred to when the gears are shifted. The gear shift reference lines are defined by the relationship between the vehicle's speed SPD and the gas pedal angle PA. As shown in FIG. 11, when there is no electric component malfunction, the throttle opening TA1 is obtained when the gas pedal angle PA is PA1. At this time, as shown in FIG. 12, if the vehicles speed SPD is SPD1, the automatic transmission shifts gears from first to second. On the other hand, when there is a malfunction in the electric component, the gas pedal angle PA needs to be PA2 to obtain the throttle opening TA1 as shown in FIG. 11. At this time, the vehicle's speed SPD needs to be SPD2, as shown in FIG. 12, to cause the automatic transmission to shift from first to second. That is, when there is a malfunction in the electric component, the vehicle's speed SPD needs to be higher to shift gears as compared to a normal state.

SUMMARY OF THE INVENTION

The present invention relates to an on-vehicle control apparatus. The engine of the vehicle includes an electronically controlled throttle valve, the opening of which is controlled by electrical and mechanical components. Accordingly, it is a primary objective of the present invention to provide an on-vehicle control apparatus that prevents a sudden increase in the torque of the engine. The engine torque is abruptly increased by a manipulation of the gas pedal when the throttle valve stops functioning due to a malfunction in an electric component of the control apparatus. The apparatus thereby improves the drivability of the vehicle.

Another objective of the present invention is to provide an on-vehicle apparatus that controls an automatic transmission. When the throttle valve stops functioning due to a malfunction in electric component in the valve, the transmission shifts the gear only at a higher vehicle's speed than in a normal state. The apparatus resolves this drawback, thereby improving the drivability of the vehicle.

To achieve the foregoing and other objects and in accordance with the purpose of the present invention, a throttle valve control apparatus for a vehicle having an internal combustion engine is provided. The engine has a throttle valve for controlling the amount of intake air, and the vehicle has an accelerator that is manipulated by the driver for actuating the throttle valve. The apparatus includes an urging member, an electric control system and a mechanical control system. The urging member urges the throttle valve towards a closed position. The electric control system electrically controls the opening of the throttle valve against the force of the urging member in accordance with the position of the accelerator. The electric control system is disabled when an abnormality is detected therein. The mechanical control system mechanically connects the accelerator with the throttle valve and opens the throttle valve against the force of the urging member if the accelerator is manipulated by more than a predetermined amount when there is an abnormality in the electrical control system. The apparatus also includes means for reducing the output torque of the engine for lowering the actual output torque of the engine to a level that is lower than normal for a given position of the throttle valve when an abnormality is detected in the electric control system.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which;

DETAILED DESCRIPTION OF THE PREFERRED EMBODIMENTS

A first embodiment of an on-vehicle control apparatus according to the present invention will now be described with reference to FIGS. 1 to 4.

Figure 1:
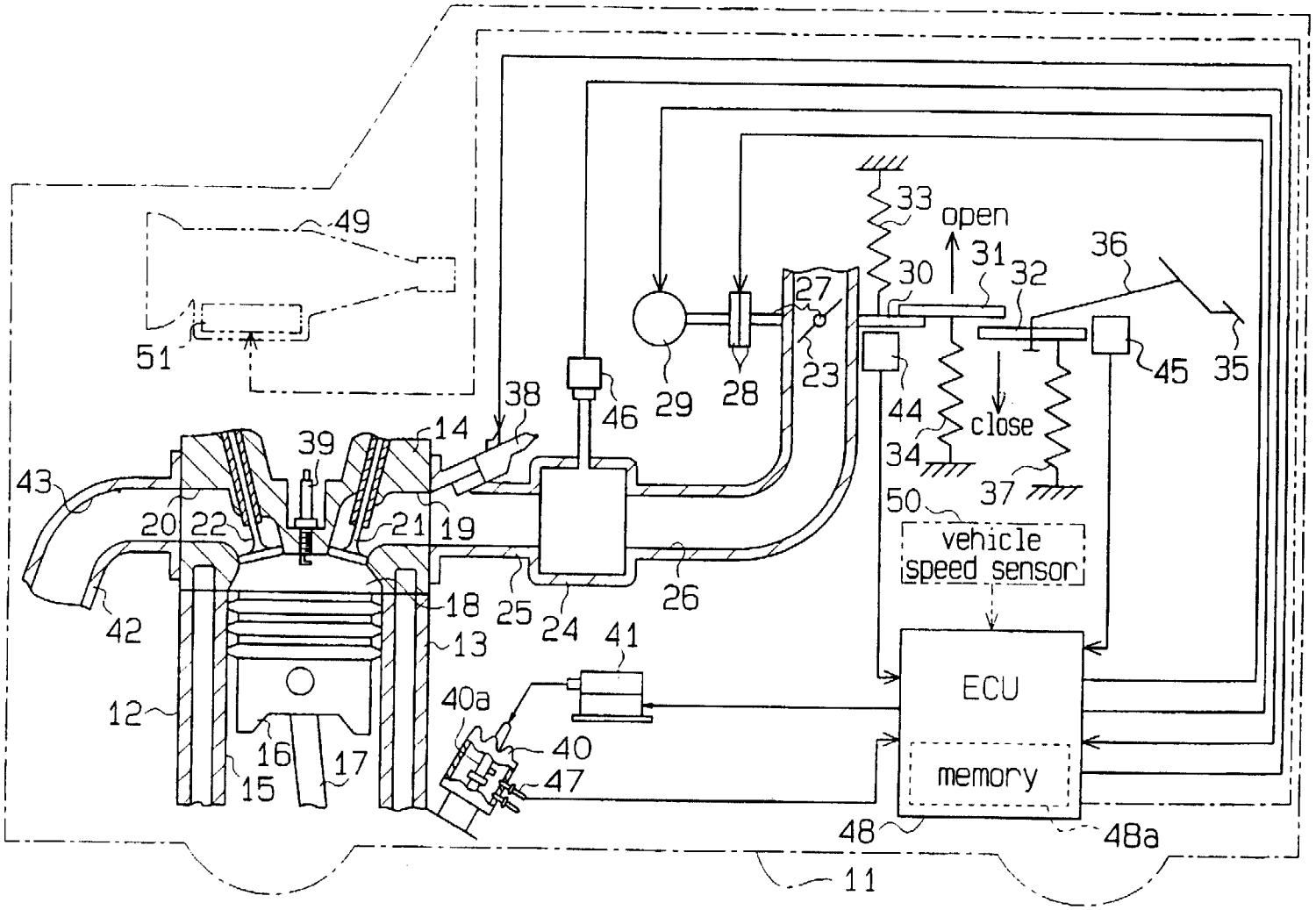
FIG. 1 is a schematic diagram illustrating an on-vehicle control apparatus according to a first embodiment of the present invention.

As shown in FIG. 1, a multi-cylinder gasoline engine 12 mounted on a vehicle 11 includes a cylinder block 13 and a cylinder head 14. A plurality of cylinder bores 15 (only one is shown) are defined in the cylinder block 13. A piston 16 is reciprocatively accommodated in each cylinder bore 15. A connecting rod 17 couples each piston 16 to a crankshaft (not shown). Reciprocation of each piston 16 is converted into rotation of crankshaft by the rod 17.

Each cylinder bore 15, cylinder head 14 and each cylinder 16 define a combustion chamber 18. A plurality of intake ports 19 (only one is shown) and a plurality of exhaust port 20 (only one is shown) are defined in the cylinder head 14. Each suction port 19 and each exhaust port 20 are communicated with the associated combustion chamber 18. A plurality of suction valves 21 (only one is shown) selectively open and close each intake port 19. Likewise, a plurality of exhaust valve 22 (only one is shown) selectively open and close each exhaust port 20.

An intake passage 26 connected to each intake port 19 includes a throttle valve 23, a surge tank 24 and an intake manifold 25. When the engine 12 is running, the air in the intake passage 26 is drawn into each combustion chamber 18.

A throttle valve 23 is supported by a throttle shaft 27 in the intake passage 26. A system for operating the throttle valve 23 includes an electric component and a mechanical component. The amount of airflow in the intake passage 26 (intake amount) is controlled by the inclination of the throttle valve 23, or the throttle opening TA. The electric component for operating the valve 23 includes an electromagnetic clutch 28 and an electric motor 29. The electromagnetic clutch 28 is located at an end (the left end in FIG. 1) of the shaft 27. The motor 29 is coupled to the shaft 27 by the clutch 28. Actuating the clutch 28 couples the motor 29 to the valve 23. De-actuating the clutch 28 disconnects the motor 29 from the valve 23. An interlocking lever 30, an intermediate lever 31 and a throttle lever 32 are located at the other end of the shaft 27 in a manner similar to the mechanism of FIG. 8.

Figure 8:
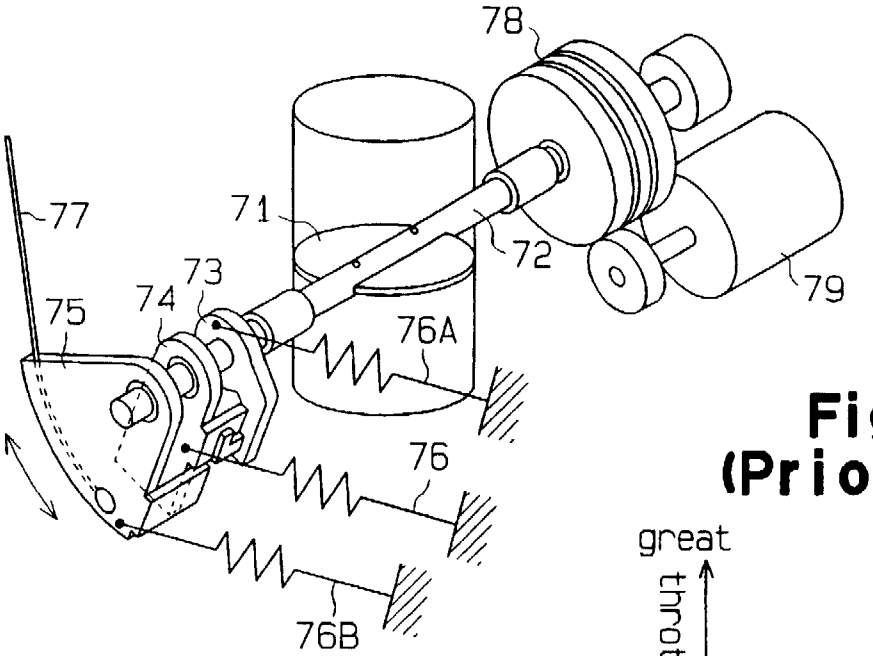
Fig.8 (Prior Art)
FIG. 8 is a diagrammatic perspective view illustrating a prior art throttle apparatus.
Figure 9:
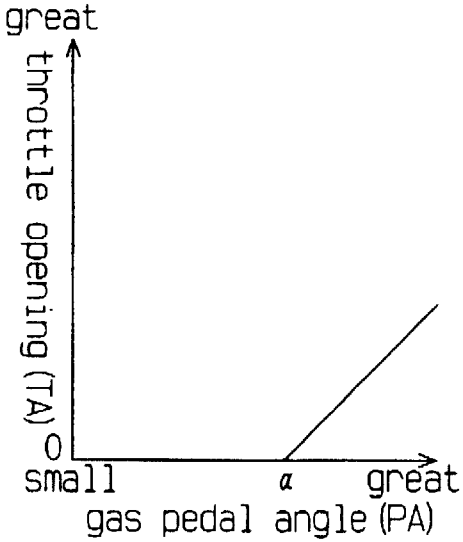
Fig.9 (Prior Art)
FIG. 9 is a graph showing the relationship between the gas pedal angle and the throttle opening in the prior art throttle apparatus.
Figure 10:
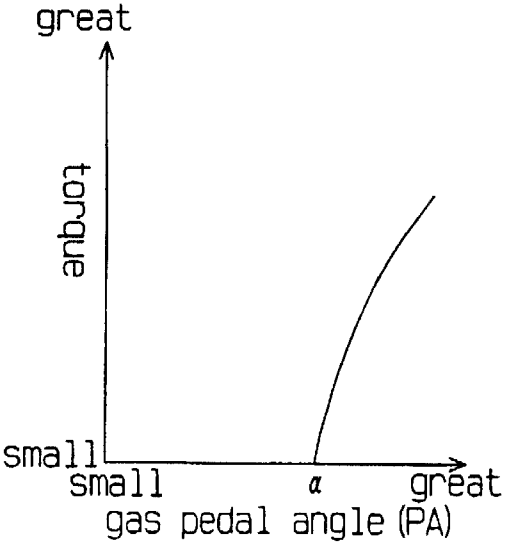
Fig.10 (Prior Art)
FIG. 10 is a graph showing the relationship between the gas pedal angle and the torque of the engine in the prior art throttle apparatus.
Figure 12:
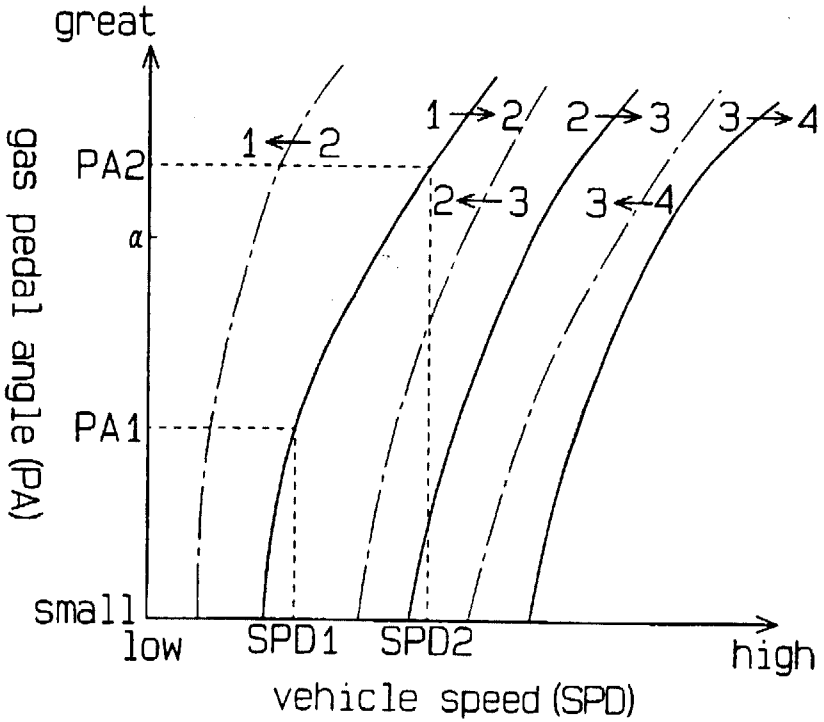
Fig.12 (Prior Art)
FIG. 12 is a graph showing function data relating to automatic transmission control in the prior art throttle apparatus.
Figure 11:
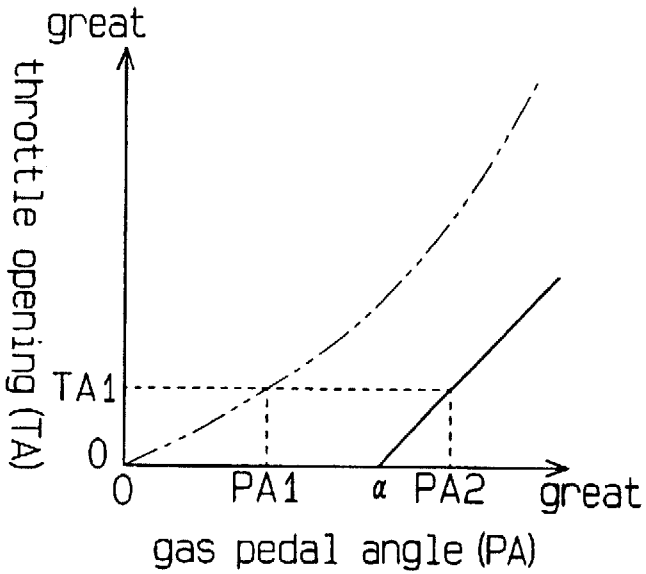
Fig.11 (Prior Art)
FIG. 11 is a graph showing the relationship between the gas pedal angle and the throttle opening in the prior art throttle apparatus.

The interlocking lever 30 is fixed to the throttle shaft 27 in a manner similar to the interlocking liver 73 of FIG. 8. A first weak spring 33 is coupled to the interlocking lever 30 and urges the lever 30 in a direction to open the throttle valve 23. The intermediate lever 31 pivots with respect to the shaft 27 like the intermediate lever 74 of FIG. 8. A second stronger spring 34 is coupled to the intermediate lever 31 and urges the lever 31 in a direction to close the throttle valve 23. The levers 30 and 31 contact and separate at their overlapping portions. The force of the second spring 34 is greater than that of the first spring 33. Therefore, when the electromagnetic clutch 28 is de-actuated to disconnect the motor 29 from the throttle valve 23, the throttle valve 23 is closed by the force of the second spring 34.

The throttle lever 32 is rotatably supported by the shaft 27 just like lever 75 of FIG. 8. A gas pedal 35 is located in the passenger compartment of the vehicle 11 and is mechanically coupled to the throttle lever 32 by a wire 36. A third spring 37 is coupled to the throttle lever 32 and urges the lever 32 in the direction to close the throttle valve 23. A protrusion formed on the lever 32 is normally separated from the intermediate lever 31. The protrusion of the throttle lever 32 contacts the intermediate lever 31 only when the motor 29 is disconnected from the throttle valve 23 by de-actuating the electromagnetic clutch 28 and the gas pedal 35 is manipulated over a predetermined distance. The mechanical component to actuate the throttle valve 23 includes the interlocking lever 30, the intermediate lever 31, the throttle lever 32, the wire 36 and the springs 33, 34 and 37.

The intake manifold 25 has a plurality of injectors 38, each of which corresponds to one of the combustion chambers 18. Each injector 38 injects fuel toward the corresponding intake port 19. The fuel injected by the injectors 38 and the airflow form an air-fuel mixture. The mixture is drawn into each combustion chambers 18. The cylinder head 14 has a plurality of spark plugs 39, each of which corresponds to one of the combustion chamber 18. Each spark plug 39 is activated by spark signals distributed by a distributor 40. The distributor 40 distributes high voltage from an igniter 41 to the spark plugs 39 in synchronization with an angle of the crankshaft's rotation. Activating the spark plug 39 burns the air-fuel mixture in the combustion chambers 18. The high pressure gas in each chamber 18 causes the piston 16 to reciprocate. The reciprocation of the pistons 16 rotates the crankshaft. The vehicle 11 has driving wheels (not shown) driven by the engine 12. The force of the engine 12 is transmitted to the driving wheels as the torque of the crankshaft and moves the vehicle 12.

An exhaust manifold 42 and a catalytic converter (not shown) are connected to each exhaust port 20 and constitute an exhaust passage 43. The burned gas in each combustion chamber 18 is discharged from the engine 12 via the exhaust passages 43.

The engine 12 is provided with various kinds of sensors 44, 45, 46, 47 that detect the running condition of the engine 12. The throttle sensor 44 detects the rotation angle of the shaft 27 of the throttle valve 23, thereby detecting the opening of the throttle valve 23, or throttle opening TA. The gas pedal sensor 45 detects the amount of manipulation of the gas pedal 35 by the driver, or the gas pedal angle PA. The intake pressure sensor 46 detects the intake pressure in the intake passage 26. The rotation speed sensor 47 detects the crankshaft's rotational speed, or the engine speed NE by referring to the rotation of a rotor 40*a* incorporated in the distributor 40.

The ECU 48 has a memory 48*a*, a central processing unit (CPU) and I/O ports. The memory 48*a* stores predetermined control programs and data. The CPU performs various computations based on control programs. The I/O ports allow the ECU 48 to transmit data to and to receive data from the sensors 44 to 47, the electromagnetic clutch 28, motor 29, the injectors 38 and the igniter 41. The ECU 48 controls the electromagnetic clutch 28, the motor 29, the injectors 38 and the igniter 41 based on the data detected by the sensors 44 to 47, thereby performing the fuel injection control, the spark timing control, throttle control and torque change control.

The ECU 48 computes an intake amount based on the detected intake pressure PM and the engine speed NE for performing the fuel injection control. The ECU 48 computes the amount of fuel in accordance with the computed intake air amount as the fuel injection amount TAU injected from each injector 38. The ECU 48 determines the fuel injection amount TAU as the length of current passage time to the solenoid coil (not shown) in the injectors 38. The ECU 48 controls the amount of fuel injected from the injectors 38 by controlling the injectors 38 based on the computed fuel injection amount TAU.

For performing a spark timing control, the ECU 48 refers to function data previously stored in the memory 48*a*. The function data has an optimal relationship between spark timings and parameters of an engine's running condition. The ECU 48 computes the running condition of the engine 12 such as load status and warm-up status based on the data detected by the sensors 44 to 47. The ECU 48 computes the optimal spark timing for the running condition by referring to the function data. The ECU 48 issues current cut-off signals to the igniter 41 based on the computed spark timings, thereby controlling the actuation timing of spark plugs 39.

For performing a throttle control, the ECU 48 computes the optimal throttle opening (a target opening) based on the gas pedal angle PA detected by the gas pedal sensor 45. The ECU 48 controls the motor 29 such that the actual throttle opening TA detected by the throttle sensor 44 matches the computed optimal opening. The ECU 48 diagnoses whether the electric component of the throttle valve 23 such as the motor 29 is functioning normally. If the actual throttle opening TA does not match or approaches the target opening when a predetermined period of time has passed after the ECU 48 transmits a command signal to the motor 29, the ECU 48 determines that there is a malfunction in the motor 29. If the ECU 48 determines that the electric component is functioning normally, the ECU 48 actuates the electromagnetic clutch 28. When the ECU 48 determines that there is a malfunction in the electric component, the ECU 48 de-actuates the electromagnetic clutch 28.

The torque change routine will now be described with reference to the flowchart of FIG. 2. The ECU 48 executes the routine with predetermined intervals.

In step 101, the ECU 48 judges whether there is an abnormality in the electric component in the throttle valve 23. If the result of the judgment is negative, the ECU 48 does not execute the subsequent steps and temporarily suspends the routine. If the judgment result is positive, on the other hand, the ECU 48 moves on to step 102.

In step 102, the ECU 48 judges whether the gas pedal angle PA is smaller than a predetermined angle $\alpha$. The angle a of the gas pedal 35 is a pedal angle at which the protrusion of the throttle lever 32 contacts the intermediate lever 31. In other words, the angle $\alpha$ is a gas pedal angle PA at which manipulation of the gas pedal 35 starts to affect the movement of the throttle valve 23 when the electric component does not function normally.

If the judgment result in step 102 is negative, the ECU 48 does not execute the subsequent steps and temporarily suspends the routine. If the judgment result is positive, on the other hand, the ECU 48 moves on to step 103.

In step 103, the ECU 48 cuts off current to some of the injectors 38 and stops supplying fuel to the corresponding combustion chambers 18, thereby temporarily suspending the routine. In this manner, the ECU 48 reduces the torque of the engine 12.

Figure 2:
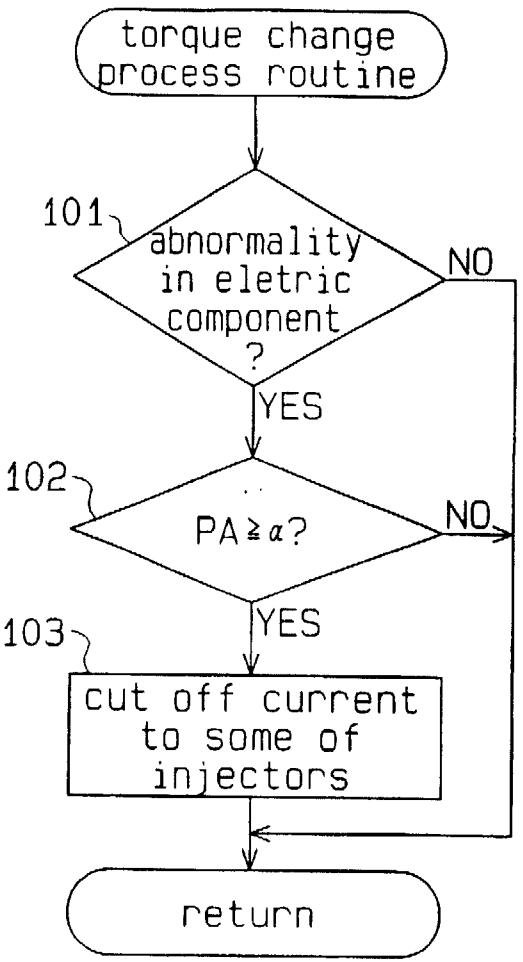
FIG. 2 is a flowchart of a torque change process routine.

When the electric component of the throttle valve 23 functions normally, the judgment result of step 101 in FIG. 2 is negative. Therefore, if the driver manipulates the gas pedal 35, steps 102 and 103 are not executed. The throttle valve 23 thus operates as follows. The protrusion of the throttle lever 32 separates from the intermediate lever 31, thereby disconnecting the throttle valve 23 from the gas pedal 35. Therefore, manipulation of the gas pedal 35 is not reflected on the movement of the throttle valve 23 by the mechanical component. The throttle valve 23 is controlled by the electric component including the motor 29 against the force of the spring 34. This allows the throttle opening TA to match the target opening, which corresponds to the manipulation amount of the gas pedal 35.

If the throttle valve 23 fails to function because of an abnormality in its electric component, the abnormality is detected by the ECU 48. In this case, the motor 29 is disconnected from the shaft 27 by de-actuating the electromagnetic clutch 28 and the spring 34 moves the throttle valve 23 to the fully closed position.

Figure 3:
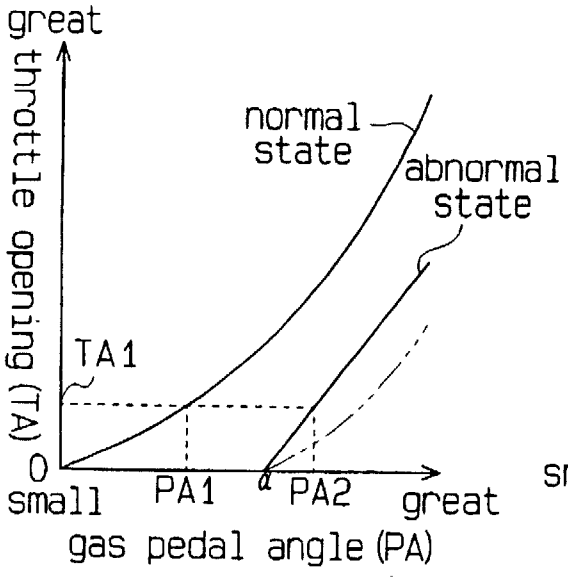
FIG. 3 is a graph showing the relationship between the gas pedal angle and the throttle opening.

FIG. 3 shows the relationship between the throttle opening TA and the gas pedal angle PA. The predetermined pedal angle α in this chart, is a gas pedal angle PA at which the throttle lever 32 contacts the intermediate ever 31. When the gas pedal angle PA is smaller than α, the throttle opening TA is zero. When the gas pedal angle PA is α or more, the throttle opening TA increases in proportion to the gas pedal angle PA. The graph of FIG. 4 shows the relationship between the torque of the engine 12 and the gas pedal angle PA.

When there is an abnormality in the electric component, if the gas pedal angle PA is smaller than the angle α as shown in FIG. 3, the protrusion on the throttle lever 32 does not contact the intermediate lever 31. The throttle opening TA thus stays zero. Accordingly, the judgment result of step 102 in the routine of FIG. 2 is negative. Steps 101 and 102 are thus repeated and the engine's torque stays low as shown in FIG. 4.

When there is an abnormality in the electric component, if the gas pedal angle PA is the predetermined value a or more, the protrusion on the throttle lever 32 contacts the intermediate lever 31. This mechanically connects the gas pedal 35 with the throttle valve 23, thereby allowing the manipulation of the gas pedal 23 to be transmitted to the throttle valve 23. The throttle valve 23 rotates against the force of the spring 34 in accordance with the manipulation amount of the gas pedal 35. Therefore, when the gas pedal angle PA is the angle α or more, the throttle opening TA increases in proportion to the increase in the gas pedal angle PA.

Figure 4:
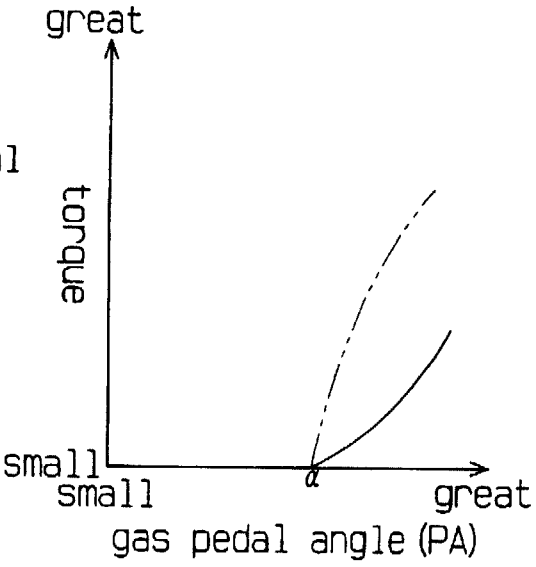
FIG. 4 is a graph showing the relationship between the gas pedal angle and the torque of an engine.

If the ECU 48 computes the fuel injection amount TAU in accordance with the intake air amount, which corresponds to the throttle opening TA, and allows all the injectors 38 to inject fuel equivalent to the amount TAU, the engine's torque shows the characteristics illustrated by a two-dot chain line in FIG. 4. Thus, the engine's torque abruptly increases when the gas pedal angle PA exceeds the angle α. In this embodiment however, the process in steps 101 to 103 prevents some of the injectors 38 from supplying fuel to the corresponding cylinders. Accordingly, the amount of fuel supplied to the combustion chambers 18 is less than that supplied in a normal condition. As a result, as illustrated with a solid line in FIG. 4, the engine's torque increases less dramatically than the rate illustrated by the two-dot chain line. In other words, when the gas pedal angle PA exceeds the angle α, an abrupt increase in the engine's torque is prevented. Accordingly, fast starts of the vehicle 11 are prevented and the drivability is improved.

A special cam may be located between the throttle lever 32 and the intermediate lever 31 to prevent an abrupt increase in the torque of the engine 12. The characteristics of the cam are illustrated with a two-dot chain line in FIG. 3. As shown in FIG. 3, the cam causes the increase in the throttle opening TA with respect to the gas pedal angle PA to be more moderate than that of the abnormal state illustrated by a solid line. This structure however increases the number of the parts in the valve's mechanical component. This increases the manufacturing cost, the size and the weight of the throttle apparatus. The previously described embodiment, on the other hand, requires no special cams.

In this embodiment, the number of the injectors 38 to which current is stopped in step 103 is readily changed. The amount of reduced torque of the engine 12 is thus controlled when a malfunction occurs in the electric component of the valve 23.

A second embodiment of an on-vehicle control apparatus will now be described with reference to FIGS. 1 and 5 to 7. To avoid a redundant description, like or same reference numerals are given to those components which are like or the same as the corresponding components of the first embodiment.

In addition to the components illustrated by solid lines in Fig. 1, the second embodiment has an automatic transmission 49 and a vehicle speed sensor 50 illustrated by two-dot chain lines. The vehicle speed sensor 50 detects the speed of the vehicle 11 SPD. In addition to stopping the fuel supply to some of the cylinders as described in the first embodiment, the shift control of the automatic transmission 49 differs between normal conditions and abnormal conditions of the valve's electric component.

The automatic transmission 49 functions as a power transmission apparatus for transmitting the rotation of the crankshaft to the driving wheels. The automatic transmission 49 is coupled to the engine 12 with a clutch (not shown). Combinations of the gear wheels in the transmission 49 convert the rotation speed of the crankshaft (engine speed NE) and the engine's torque at various ratios. The transmission 49 has four gear ratios including a first gear for low speed and a fourth gear for high speed. The automatic transmission 49 has a hydraulic circuit (not shown) and a solenoid valve 51. The hydraulic circuit changes the combination of the gear wheels and thus the gear ratio. The solenoid valve 51 controls oil pressure to the hydraulic circuit for switching the gears.

Figure 6:
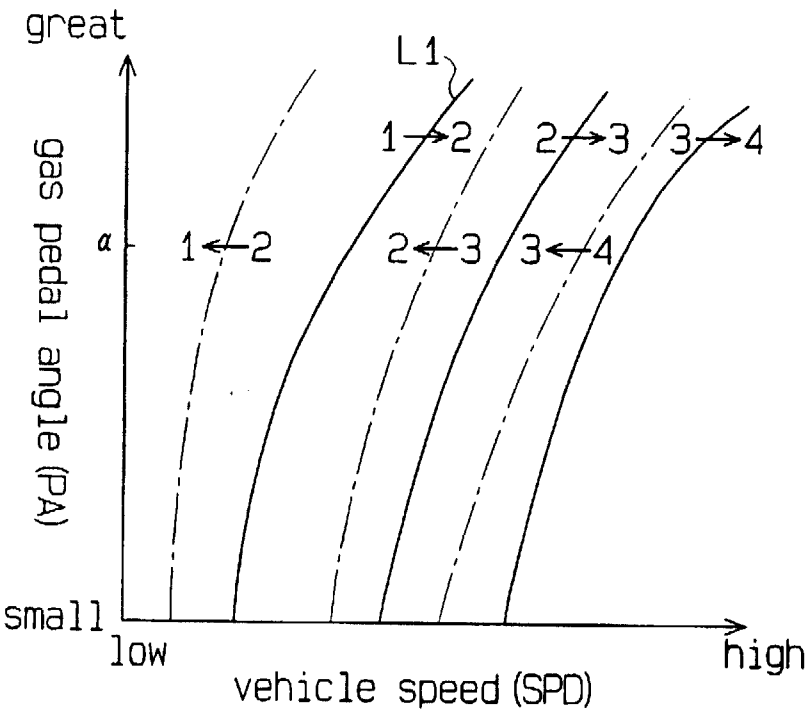
FIG. 6 is a graph showing function data of the automatic transmission control when there is no malfunction in an electric component.

The ECU 48 refers to a function data shown in FIG. 6 stored in the memory 48*a* when switching the gears. The solid lines and one-dot chain lines in FIG. 6 are reference lines for shifting the gears. These shift reference lines are defined by the relationship between the vehicle speed SPD and the gas pedal angle PA. Each one-dot chain line is referred to when the gear is shifted down to a lower gear and each solid line is referred to when the gear is shifted up to a higher gear.

The ECU 48 selects a gear corresponding to the relationship between the vehicle speed SPD and the gas pedal angle PA by referring to the function data shown in FIG. 6. Then the ECU 48 controls the solenoid valve 51 such that the actual gear matches the selected one. When the point corresponding to the vehicle speed SPD and the gas pedal angle PA on the graph in FIG. 6 crosses a solid line or a one-dot chain line, the ECU 48 issues a command signal to the solenoid valve 51. The command signal causes the solenoid valve 51 to change oil flow to the hydraulic circuit. This either shifts the gears up or down. If the point corresponding to SPD and PA does not cross a line on the graph, the ECU 48 issues a command signal to the solenoid valve 51 for maintaining the current gear.

Figure 5:
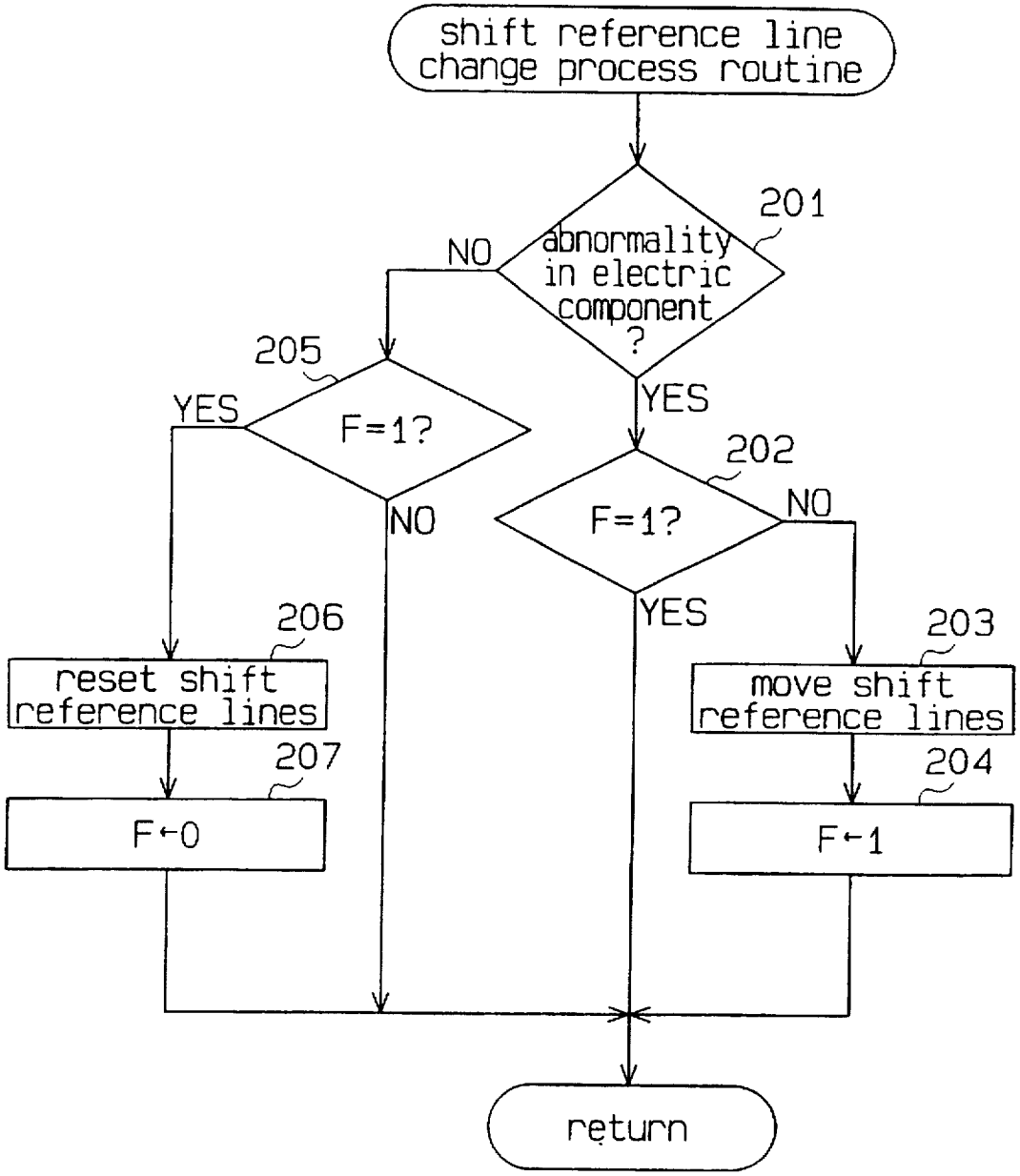
FIG. 5 is a flowchart of a routine for moving shift reference lines according to a second embodiment of the present invention.

Fig. 5 shows a routine for moving shift reference lines. While the engine 12 is running, the ECU 48 executes the routine at predetermined intervals. The ECU 48 refers to an abnormality flag F in this routine. The abnormality flag F indicates the condition of the electric component of the throttle valve 23. That is, when the throttle valve's electric component functions normally, the flag F has a value "0" and when the component has an abnormality, the flag F has a value "1".

In step 201, the ECU 48 judges whether there is an abnormality in the electric component of the throttle valve 23. If the judgment result is positive, the ECU 48 moves on to step 202.

In step 202, the ECU 48 judges if the abnormality flag F has a value "1". If the judgment result is positive (F=1), the ECU 48 temporarily suspends the routine without executing the subsequent steps. If the judgment result is negative (F=0), the ECU 48 moves on to step 203.

In step 203, the ECU 48 moves the shift reference lines on the function data stored in the memory 48a toward the low vehicle speed SPD side. In step 204, the ECU 48 gives a value "1" to the flag F and temporarily suspends this routine.

Taking a line L1 in FIG. 6 as an example, the movement of the shift reference lines on the graph will be explained. The line L1 is referred to when the gear is shifted up from first gear to second gear. It is assumed that the throttle opening TA is TA1 as shown in FIG. 3. When the electric component functions normally, the ECU 48 computes a gas pedal angle PA1 so that TA1 corresponds to the PA on the graph. When there is an abnormality in the electric component, the ECU 48 computes a gas pedal angle PA2 so that TA1 matches the PA on the graph.

Figure 7:
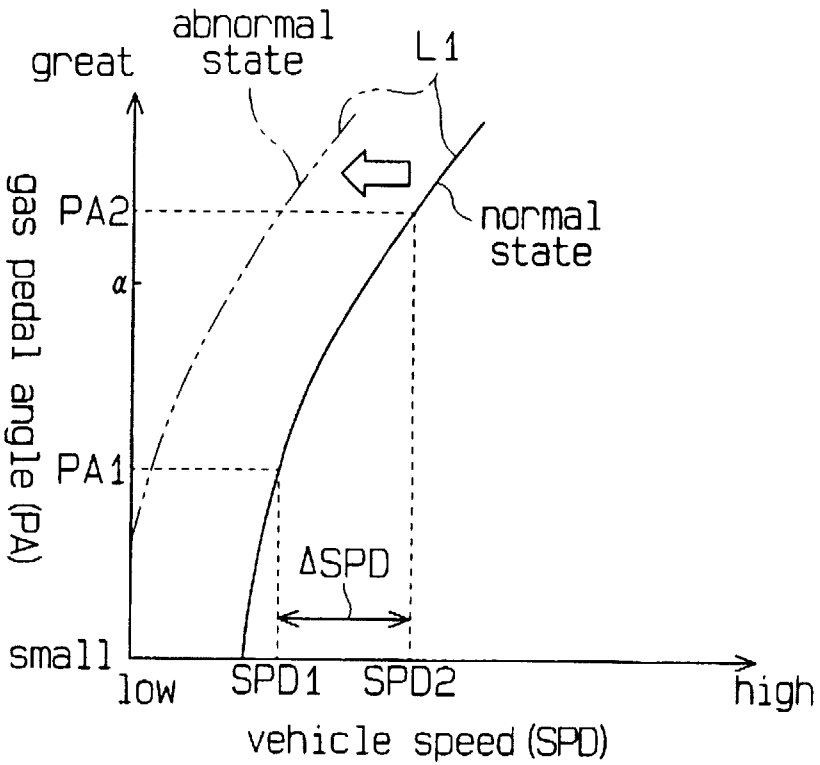
FIG. 7 is a graph showing the difference between sets of function data used for an automatic transmission in normal and abnormal states of electric component in a throttle valve.

As shown in FIG. 7, when the gas pedal angle PA is PA1, the ECU 48 refers to the line L1 to compute the vehicle's speed SPD1 at which the gear is shifted from first gear to second gear. Similarly, when the gas pedal angle PA is PA2, the ECU 48 refers to the line L1 to compute the vehicle's speed SPD2 at which the gear is shifted from first to second. Further, the ECU 48 computes the difference between the vehicle's speeds SPD2 and SPD1 as a value ΔSPD. The ECU 48 moves the shift reference line L1 toward the low speed side (that is, to the left in FIG. 7) by the amount of ΔSPD. The shift reference line L1, which is illustrated by an solid line in FIG. 7 when the electric component functions normally, is moved to the position illustrated by a two-dot chain line in FIG. 7. The movement of the shift reference line L1 causes the gear to be shifted substantially at the same vehicle's speed SPD when there is an abnormality in the electric component as when there is no abnormality. The other shift reference lines are moved in the same manner.

Back to FIG. 5, when the judgment result in step 201 is negative, the ECU 48 goes to step 205. In step 205 the ECU 48 judges whether the abnormality flag F is "1". If the judgment result is negative (F=0), the ECU 48 temporarily suspends the routine without executing the subsequent steps. If the judgment result is positive (F=1), the ECU 48 moves on to step 206.

In step 206, the ECU 48 resets the position of the shift reference lines, which have been moved in step 203. That is, as shown in FIG. 7, the line L1, which has been moved to the position illustrated by a two-dot chain line, is moved back to the position illustrated by a solid line. In step 207, the ECU 48 gives a value "0" to the abnormality flag F and temporarily suspends the routine.

When the electrical component in the throttle valve 23 functions normally, steps 201 and 205 in FIG. 5 are repeated. The ECU 48 shifts the gear of the automatic transmission 49 by referring to the relationship between the vehicle's speed SPD and the gas pedal angle PA in the function data shown in FIG. 6.

When there is an abnormality in the electric component in the throttle valve 23, the throttle valve 23 is actuated by the mechanical component. In this case, right after the switch from the electric component to the mechanical component, the process from step 201 to 204 in FIG. 5 is executed. This moves the shift reference lines toward the low vehicle's speed side by the amount of ΔSPD. Thereafter, so long as the abnormal condition continues, steps 201 and 202 are repeated and the automatic transmission is controlled based on the moved shift reference lines. In the prior art apparatus, the shift reference lines are fixed. Therefore, with an abnormality in the electric component of the throttle valve, the gear is shifted at a higher vehicle speed SPD than in a normal state. Unlike the prior art apparatus, this embodiment causes the gear to be shifted at the same speed as the normal state even if there is an abnormality in the electric component. Therefore, the abnormality in the electric component in the throttle valve does not deteriorate the drivability of the vehicle 11 and the automatic transmission 49 changes gears without making the driver uncomfortable.

Although only two embodiments of the present invention have been described herein, it should be apparent to those skilled in the art that the present invention may be embodied in many other specific forms without departing from the spirit or scope of the invention. Particularly, the invention may be embodied in the following forms:

In the above described first embodiment, the process in step 103 in FIG. 2 may be modified as follows. Instead of cutting current to some of the injectors 38, the current passage time to all the injectors 38 may be equally shortened by a certain amount, or the timing of the plugs 39 may be slightly delayed. Further, both current cutting to a some of the injectors 38 and spark timing delay may be performed. In these cases, when there is an abnormality in the electric component of the throttle valve 23, the torque of the engine 12 is reduced and the vehicle's drivability is not deteriorated.

In the above described second embodiment, the shift reference lines in the function data are moved by the amount of ΔSPD. However, the amount of the lines' movement may be altered. In this case, the lines must be moved toward the low speed side as in the second embodiment. The amount of the movement is preferably close to ΔSPD. This causes the automatic transmission 49 to shift gears in an abnormal state substantially at the same vehicle's speed SPD as in the normal state.

In the second embodiment, the process in steps 205 to 207 in FIG. 5 may be omitted. If the judgment result in step 201 is positive, that is, when the electric component functions normally, the ECU 48 may suspend the routine without executing the subsequent steps.

In the first and second embodiments, the prior art apparatus (Japanese Unexamined Patent Publication No.

5-71365) may be employed for detecting an abnormality in the electric component. In this case, the intermediate lever 31 is provided with a contact switch. The switch is turned on when the intermediate lever 31 is separated from the interlocking lever 30 and turned off when the levers 31 and 30 contact. The ECU 48 detects an abnormality when the motor 29 rotates the throttle valve 23 to open the valve 23 to an amount such that the contact switch is turned off.

In the second embodiment, a set of shift reference lines may be previously prepared for an abnormal state in addition to the set of shift reference lines for a normal state. In this case, different sets of the shift reference lines are used in a normal state and an abnormal state.

Therefore, the present examples and embodiments are to be considered as illustrative and not restrictive and the invention is not to be limited to the details given herein, but may be modified within the scope of the appended claims.

What is claimed is:

1. An apparatus of controlling vehicle speed, said vehicle having an engine with a throttle valve being arranged to vary the opening thereof to control the amount of intake air supplied to the engine so as to change the vehicle speed, the vehicle having an accelerator for controlling the opening of the throttle valve, wherein the throttle valve is urged toward a closed position by an urging member, and wherein the throttle valve is opened by the accelerator manipulated to a predetermined effective position, the apparatus comprising:

means for electrically adjusting the opening of the throttle valve against the force of the urging member in accordance with the position of the accelerator;

means for mechanically coupling the accelerator to the throttle valve against the force of the urging member to control the opening of the throttle valve;

means for detecting an occurrence of a malfunction in the adjusting means;

means for deactivating the adjusting means based on the malfunction therein;

means for shifting the predetermined effective position of the accelerator to an increased manipulated position based on the malfunction in the adjusting means; and means for decreasing the vehicle speed with respect the vehicle speed based on the position of the accelerator whose effective position is shifted to the increased manipulated position.

2. The apparatus as set forth in claim 1, wherein said adjusting means includes:

an electric motor for adjusting the opening of the throttle valve;

an electromagnetic clutch for providing a the throttle valve with a connection with or disconnection from the electric motor; and means for instructing the electromagnetic clutch to disconnect the electric motor from the throttle valve.

3. The apparatus as set forth in claim 2, wherein said decreasing means has means for lowering output torque of the engine.

4. The apparatus as set forth in claim 3 further comprising:

a plurality of injectors electrically actuated to inject fuel so as to drive the engine; and means for deactivating a part of the injectors based the malfunction in the adjusting means.

5. The apparatus as set forth in claim 3 further comprising an electric control unit forming the deactivating means, the, shifting means, the decreasing means and the instructing means.

6. The apparatus as set forth in claim 2 further comprising said decreasing means including:

an automatic gear transmission for converting engine speed and engine torque to the vehicle speed at transmitting ratios respectively predetermined for a plurality of stages of the vehicle speed from a minimum stage to a maximum stage;

means for computing a corrected value of each predetermined transmitting ratio, wherein said corrected value is shifted toward the minimum stage from each of the predetermined transmitting ratio by a variation computed based on the shift of the vehicle speed; and means for actuating the automatic gear transmission based on the computed corrected value.

7. The apparatus as set forth in claim 6 further comprising an electric control unit forming the deactivating means, the shifting means, the decreasing means, the instructing means, the computing means and actuating means.

8. An apparatus of controlling vehicle speed, said vehicle having an engine with a throttle valve being arranged to vary the opening thereof to control the amount of intake air supplied to the engine so as to change vehicle speed, the vehicle having an accelerator for controlling the opening of the throttle valve, wherein the throttle valve is urged toward a closed position by an urging member and, wherein the throttle valve is opened by the accelerator manipulated to a predetermined effective position, the apparatus comprising:

means for electrically adjusting the opening of the throttle valve against the force of the urging member in accordance with the position of the accelerator;

means for mechanically coupling the accelerator to the throttle valve against the force of the urging member to control the opening of the throttle valve;

means for detecting an occurrence of a malfunction in the adjusting means;

means for selectively driving the adjusting means and the coupling means, said driving means including means for deactivating the adjusting means based on the malfunction therein, said driving means including means for shifting the predetermined effective position of the accelerator to an increased manipulated position based on the malfunction in the adjusting means;

a plurality of injectors electrically actuated to inject fuel so as to drive the engine; and means for deactivating a part of the injectors based the malfunction in the adjusting means.

9. The apparatus as set forth in claim 8, wherein said adjusting means includes:

an electric motor for adjusting the opening of the throttle valve;

an electromagnetic clutch for providing a the throttle valve with a connection with or disconnection from the electric motor; and means for instructing the electromagnetic clutch to disconnect the electric motor from the throttle valve.

10. The apparatus as set forth in claim 9 further comprising an electric control unit forming the deactivating means, the, shifting means, the decreasing means and the instructing means.

11. An apparatus of controlling vehicle speed, said vehicle having an engine with a throttle valve being arranged to vary the opening thereof to control the amount of intake air supplied to the engine so as to change vehicle speed, the vehicle having an accelerator for controlling the opening of the throttle valve, wherein the throttle valve is urged toward a closed position by an urging member and, wherein the throttle valve is opened by the accelerator manipulated to a predetermined effective position, the apparatus comprising:

means for electrically adjusting the opening of the throttle valve against the force of the urging member in accordance with the position of the accelerator;

means for mechanically coupling the accelerator to the throttle valve against the force of the urging member to control the opening of the throttle valve;

means for detecting an occurrence of a malfunction in the adjusting means;

means for selectively driving the adjusting means and the coupling means, said driving means including means for deactivating the adjusting means based on the malfunction therein, said driving means including means for shifting the predetermined effective position of the accelerator to an increased manipulated position based on the malfunction in the adjusting means;

an automatic gear transmission for converting engine speed and engine torque to the vehicle speed at transmitting ratios respectively predetermined for a plurality of stages of the vehicle speed from a minimum stage to a maximum stage;

means for computing a corrected value of each predetermined transmitting ratio, wherein said corrected value is shifted toward the minimum stage from each of the predetermined transmitting ratio by a variation computed based on the shift of the vehicle speed; and means for actuating the automatic gear transmission based on the computed corrected value.

* * * * *